US006188427B1

(12) United States Patent
Anderson et al.

(10) Patent No.: US 6,188,427 B1
(45) **Date of Patent: *Feb. 13, 2001**

(54) ILLUMINATION SYSTEM HAVING AN INTENSITY CALIBRATION SYSTEM

(75) Inventors: Charles H. Anderson, Dallas; John B. Allen, Lucas, both of TX (US)

(73) Assignee: Texas Instruments Incorporated, Dallas, TX (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/063,027

(22) Filed: Apr. 20, 1998

Related U.S. Application Data

(60) Provisional application No. 60/044,246, filed on Apr. 23, 1997.

(51) Int. Cl.[7] ..... B41J 2/47

(52) U.S. Cl. ..... 347/255; 347/238; 347/239; 348/770; 348/771

(58) Field of Search ..... 347/237, 238, 347/239, 240, 246, 236, 247, 255, 256; 364/528.21; 355/85, 400; 359/15, 224; 348/755, 764, 770, 771; 250/551; 362/242, 246

(56) References Cited

U.S. PATENT DOCUMENTS 4,907,034 * 3/1990 Doi et al. ..... 355/400
5,369,423 * 11/1994 Hunter et al. ..... 347/255
5,448,749 * 9/1995 Kyuma et al. ..... 364/528.21
5,481,118 * 1/1996 Tew ..... 250/551
5,493,322 * 2/1996 Ng et al. ..... 347/240
5,694,161 * 12/1997 Oikawa et al. ..... 347/237
5,796,508 * 8/1998 Suzuki ..... 359/224
5,828,471 * 10/1998 Davis et al. ..... 359/15
5,859,659 * 1/1999 Araki et al. ..... 347/246
5,954,424 * 9/1999 Anderson et al. ..... 362/242

* cited by examiner

*Primary Examiner*—N. Le
*Assistant Examiner*—Hai C. Pham
(74) *Attorney, Agent, or Firm*—Wade James Brady, III; Frederick J. Telecky, Jr.

(57) ABSTRACT

An illumination system (10) having an automated calibration system (62) for adjusting the light intensity of individual elements (14) of an array of light emitting elements (12). An optical sensor (30) can be positioned in several locations (A,B,C) to sense incident light from a spatial light modulator (20) as the modulator is sequentially actuated one zone (50) at a time. The light output from each zone (50) of the spatial light modulator is characterized and compared to a golden standard, and the light emitting elements of the array associated with illuminating the zones that are deficient in light are ascertained. Adjustment circuitry (62) responsively adjusts and increases the drive current to the associated light emitting elements (14) that are deficient in light output. A look-up table is utilized to determine which LEDs (14) need adjustment to their drive currents to insure uniform illumination in the process and cross-process direction at an image plane. The present invention is ideally suitable for xerographic printers.

15 Claims, 3 Drawing Sheets

ILLUMINATION SYSTEM HAVING AN INTENSITY CALIBRATION SYSTEM

CROSS REFERENCE TO RELATED APPLICATIONS

This application claims priority under 35 U.S.C. § 119 (e) (1) of provisional application number 60/044,246 filed Apr. 23, 1997.

Cross reference is made to the following co-pending patent applications, each being assigned to the same assignee as the present invention and the teachings included herein by reference:

| SERIAL # | NAME | FILED |
|---|---|---|
| 08/371,348 | DMD Modulated Continuous Wave Light source for Xerographic Printer | 01-11-95 |
| 08/735,616 | Illumination System for Hard Copy Apparatus | 10-23-96 |
| 07/809,996 | System and Method for Achieving Gray Scale Spatial Light Modulator Operation | 12-18-91 |
| 08/738,386 | Multiple Emitter Illuminator Engine | 10-25-96 |

FIELD OF THE INVENTION

This invention relates generally to an image display system such as used in a xerographic printer, and more particularity, to an illumination system having a calibration system for providing a uniform distribution of high-intensity light to an image plane.

BACKGROUND OF THE INVENTION

Semiconductor spatial light modulators (SLM's) are one viable solution to realizing high quality, affordable xerographic printers. One promising SLM technology suitable for both printers and displays is the deformable mirror device or digital micromirror device (collectively DMD) manufactured by Texas Instruments Incorporated of Dallas, Tex. The DMD is a monolithic semiconductor device having a linear or area array of bi-stable movable micromirrors fabricated over an array of corresponding addressing memory cells. One embodiment of a xerographic printer implementing a tungsten light source focused via optics on an imaging DMD mirror array is disclosed in U.S. Pat. No. 5,041,851 to Nelson, entitled "Spatial Light Modulator Printer and Method of Operation", assigned to the same assignee as the present application and the teachings included herein by reference.

In a xerographic printer implementing an imaging DMD spatial light modulator, it is desired to uniformly illuminate the elongated DMD mirror array (typically about 5 inches in length) with a homogeneous light source such that each pixel mirror of the array modulates a uniform intensity portion of light. This is necessary because the DMD mirror array modulates this light to expose a light sensitive rotating printing drum, whereby the intensity and duration of the modulated light directed thereon determines the relative exposure of the charged drum. The exposed portion of the drum comprises a latent image, wherein a quantity of toner will adhere to the drum image, this toner then being transferred to a printing medium such as paper, and fused thereon using heat.

It is also necessary that the energy of the light directed upon the DMD mirror array be of sufficient flux per unit area to fully expose the rotating printing drum to obtain a dark image. If insufficient light energy is modulated and directed to the drum by the DMD mirror array, the printing drum may not be fully exposed, thus degrading the contrast of the image printed on a printing medium.

U.S. Pat. No. 5,159,485 to Nelson, entitled "System and Method for Uniformity of Illumination for Tungsten Light", assigned to the same assignee of the present invention and the teachings included herein by reference, discloses an anamorphic optical path arranged such that the vertical component of the source light beam is compressed to match the physical shape of the DMD mirror array. The embodiment disclosed dramatically increases the optical efficiency of the system, whereby light energy is compressed to irradiate the DMD mirror array more intensely from a given light source, such as a tungsten lamp.

U.S. Pat. No. 5,105,207 to Nelson, entitled "System and Method for Achieving Gray Scale DMD Operation", assigned to the same assignee as the present invention and the teachings incorporated herein by reference, discloses a system for enhancing resolution of a xerographic process by submodulation of each individual pixel. The submodulation is achieved by anamorphically reducing the square pixel presentation of light rays to a rectangle having a number of controllable segments within each square pixel scanned line. A conventional tungsten lamp is incorporated in this embodiment.

U.S. Pat. No. 5,151,718 to Nelson, entitled "System and Method for Solid State Illumination for DMD Devices", also assigned to the same assignee of the present invention and the teachings included herein by reference, discloses an array of LED emitters constructed to efficiently replace the conventional tungsten source lamp. The LED array is geometrically configured, and can be electrically operated by strobing to vary the brightness of light to individual mirror pixels to achieve gray scale imaging, and reduce fuzzy line images. Each of the LED's in the array can be provided with a lens to help collimate the light through optics and onto the DMD mirror array. Using LED's, light is efficiently directed and focused onto the DMD mirror array, with little light being wasted and directed elsewhere. Less optical energy is required of the light source compared to a conventional tungsten lamp to illuminate the DMD mirror array with a particular light intensity. The LED's can be quickly turned on and off, thereby providing the ability to modulate the light energy directed upon the DMD mirror array, and consequently, helps achieve gray scale printing. For instance, during a given line print cycle, the LED can be on for 50% of the cycle time to irradiate the DMD array with half the light energy available for that particular time interval. The alignment of the optics ensures that the energy of each LED is directed upon the DMD mirror array. There is a concern that, the LED array may not produce sufficient and uniform light energy in the cross-process direction should one LED fail or have a reduced output.

As disclosed in commonly assigned patent application Ser. No. 08/735,616, entitled "Illumination System for Hard Copy Apparatus", there is disclosed an illumination system having an elongated array of light emitting elements in combination with a spreading element which laterally mixes the light from the individual light elements for illuminating an elongated spatial light modulator. A holographic diffuser is implemented to laterally diffuse and mix the light in the cross-process direction, in combination with a cylindrical lens to vertically compress the light. A 10% reduction in light output from one of the light elements will cause less than a 1% localized reduction in light intensity at the spatial light modulator.

It is known that over time the intensity of the light output of the light emitting elements will vary and degrade over time. There is desired an illumination system having a calibration system which has the capability to automatically measure the intensity of illumination across a spatial light modulator to determine the uniformity of illumination across the image plane. Such a system should allow adjustment of the individual light emitting elements light output of an array to insure uniform illumination at the image plane over time.

SUMMARY OF THE INVENTION

The present invention achieves technical advantages as an illumination system having an automatic illumination detection system for determining the uniformity of illumination across an image plane, and calibration of individual light source elements to maintain uniformity. This is done by sensing the intensity of light reflected by or transmitted through a spatial light modulator at the object plane as the spatial light modulator is turned on, one zone or block at a time, across the spatial light modulator. Each one of the actuated zones will produce its own light signature which is compared to a set of calibration signatures stored in a look-up table. The look-up table can be originated/derived by computer models or empirical measurements from a golden standard light source implemented in an actual optical system which produces uniform illumination at the image plane. Appropriate specifications on uniformity versus detector readings relative to the standard stored in the look-up table are used for full characterization of the illumination sources. Using the detector readings associated with each activated spatial light modulator zone, variations in light emitting element outputs relative to what they should be are readjusted to previously specified levels. This insures proper illumination across the spatial light modulator by the array of light emitting elements, matching the standard, to ensure uniform illumination at the image plane.

In the preferred embodiment of the present invention, a reflective-type spatial light modulator such as a DMD is utilized, although a transmissive-type spatial light modulator could be used such as a LCD. This DMD spatial light modulator reflects light which can be detected in one of three ways. First, the detector can be placed in the "off-state" to detect reflected light from the DMD when a zone of mirrors is in the "off-state". Secondly, detection of reflected light can be obtained by placing the sensor on one side, or placing a detector on both sides, of the projector lens to sample diffused "on-state" light which extends either side of the lens diameter when a zone of mirrors is in the "on-state". Thirdly, detection of reflected light can be obtained with the sensor by sampling the portion of the "on-state" light from a zone of "on-state" mirrors which passes through the center of the projection lens using a reflector which can be selectively inserted in the optical path to reflect on-state light to the sensor. Alternatively, detection of reflected light can be obtained using a microminiature CCD camera positioned in close proximity to the image plane to sample light across the image plane. All four of these approaches provide calibration to maintain process and cross-process illumination uniformity at the image plane of an image display system, such as a xerographic printer.

To characterize the array of light sources, the spatial light modulator is turned on in zones or blocks, one zone at a time, so that the detector can ascertain the corresponding light intensity directed thereto as each zone is actuated. Zones of the spatial light modulator can be actuated in both the lateral and vertical direction, thus allowing for characterization of the illumination in both the cross-process and process direction.

In one preferred embodiment of the present invention, a DMD array having a size being 64 pixels high and 7,056 pixels wide is actuated in 64×48 pixel zones, which is a total of 147 zones in the lateral direction. Again, each of the actuated zones, being either on or off, will produce its own signature based on the light illuminating that zone of the spatial light modulator. Intensity at each zone of pixels is a function of the summed light outputs from the individual light emitting elements forming the light emitting array. Calibration circuitry then adjusts the output intensity levels of the individual light emitting elements as a function of the sensed signatures to insure that the spatial light modulator properly illuminated in the cross-process and process direction, within a certain tolerance. For instance, pixel zones could be selected that are 16 pixels high and 1,411 wide, creating 4 zones of pixels in the vertical direction and 5 zones of pixels laterally for a total of 20 zones.

The illumination system of the present invention comprises an array of light emitting elements emitting light. A light mixing device mixes the light from the light emitting elements in the lateral direction. A spatial light modulator having an array of pixel elements is illuminated by the mixed light. A light sensor provides a light sensor output and is also illuminated by the mixed light, and can be positioned in one of several locations. Adjustment circuitry individually adjusts the intensity of the individual light emitting elements as a function of the light sensor output.

The adjustment circuitry selectively controls blocks or zones of pixels in the pixel array of the spatial light modulator. The adjustment circuitry selectively controls the entire pixel array to characterize the intensity of the emitted light of each light emitting element, by determining the intensity of light across the spatial light modulator one zone at a time, and then adjusts the individual element light outputs when necessary to achieve uniformity at the image plane, within tolerance.

In one embodiment, the illumination system of the present invention includes a projector lens focusing modulated light from the spatial light modulator along an optical path to an image plane. In this embodiment, one sensor is positioned each side and adjacent the projector lens to sense the intensity of reflected light which overfills the projector lens, and the sensor outputs are summed. Preferably, the spatial light modulator comprises a reflective type device such as a DMD, but could also comprise a transmissive type device such as a LCD.

In a second alternative embodiment, a reflective type DMD is utilized having an array of reflectable elements, each element being deflectable between a "on-state" and an "off-state". The sensor is positioned to sense reflected light from each of the reflectable elements in the "off-state".

In a third embodiment, a reflector is provided that is selectively positionable in the optical path of the illumination system to direct light from the projector lens to the sensor.

In all of the embodiments, the spatial light modulator is actuated in zones to allow the sensor to detect light from each zone and characterize the light output of each light emitting element forming the array.

DETAIL DESCRIPTION OF THE PREFERRED EMBODIMENT

Figure 1:
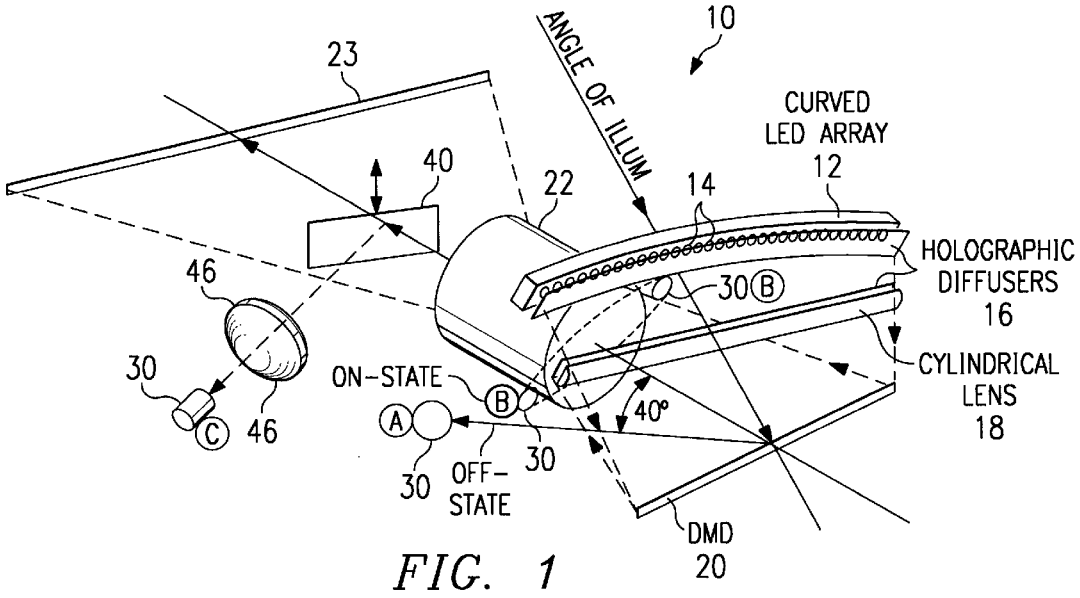
FIG. 1 is a perspective view of three preferred embodiments of the present invention whereby an optical detector can be placed adjacent the projector lens, in the "off-state" of a DMD spatial light modulator, or positioned to sense light from a reflector selectively placed in the optical path behind the projection lens.

Referring now to FIG. 1, there is generally shown at 10 an illumination system according to the preferred embodiment of the present invention. System 10 is seen to include an elongated curved array 12 of light emitting elements 14 with the light output from the individual elements 14 being thoroughly mixed in the lateral or cross-process direction by a pair of light spreading elements 16. The mixed light from spreading elements 16 is then compressed in the vertical (process) direction by a cylindrical lens 18, and thereafter is directed upon an elongated spatial light modulator (SLM) 20, which is preferably a digital micromirror device (DMD) such as that manufactured by Texas Instruments of Dallas, Tex. SLM 20 could also be comprised of other types of reflective or transmissive spatial light modulators, if desired, including liquid crystal displays etc. Spatial light modulator 20 modulates the incident light at an object plane and forms a light image which is directed into a projection lens 22. Projection lens 22 focuses the imaged light from the spatial light modulator 20 to an image plane 23, such as an organic photoconductor (OPC). A pair of lenses 18 may be utilized if desired, to effectively compress and converge the elongated beam of light from elongated array 12 and image the light from the light emitting elements onto the spatial light modulator 20. In the preferred embodiment, light mixing devices 16 are preferably holographic diffusers, but could also be comprised of other devices including a glass plate light integrator or a transmitting phase grating.

Still referring to FIG. 1, there are shown several alternative preferred embodiments of the present invention whereby a light sensor or sensors 30, such as a photodiode, is used to sense the intensity of reflected light from the DMD spatial light modulator 20 to determine process and cross-process illumination uniformity at the image plane. The determination of the illumination across the spatial light modulator is used to automatically calibrate the light intensity output of each of the light emitting elements 14 by setting drive currents such that the spatial light modulator 20 is always properly illuminated, within tolerance, to obtain illumination uniformity at the image plane. The automatic calibration system of the present invention is especially useful since the light output of the LED's 14 typically vary over time. The present invention allows recalibration of the individual light outputs by adjusting the driving signal to each LED 14, or LED module comprising more than one emitter, if necessary.

Figure 2:
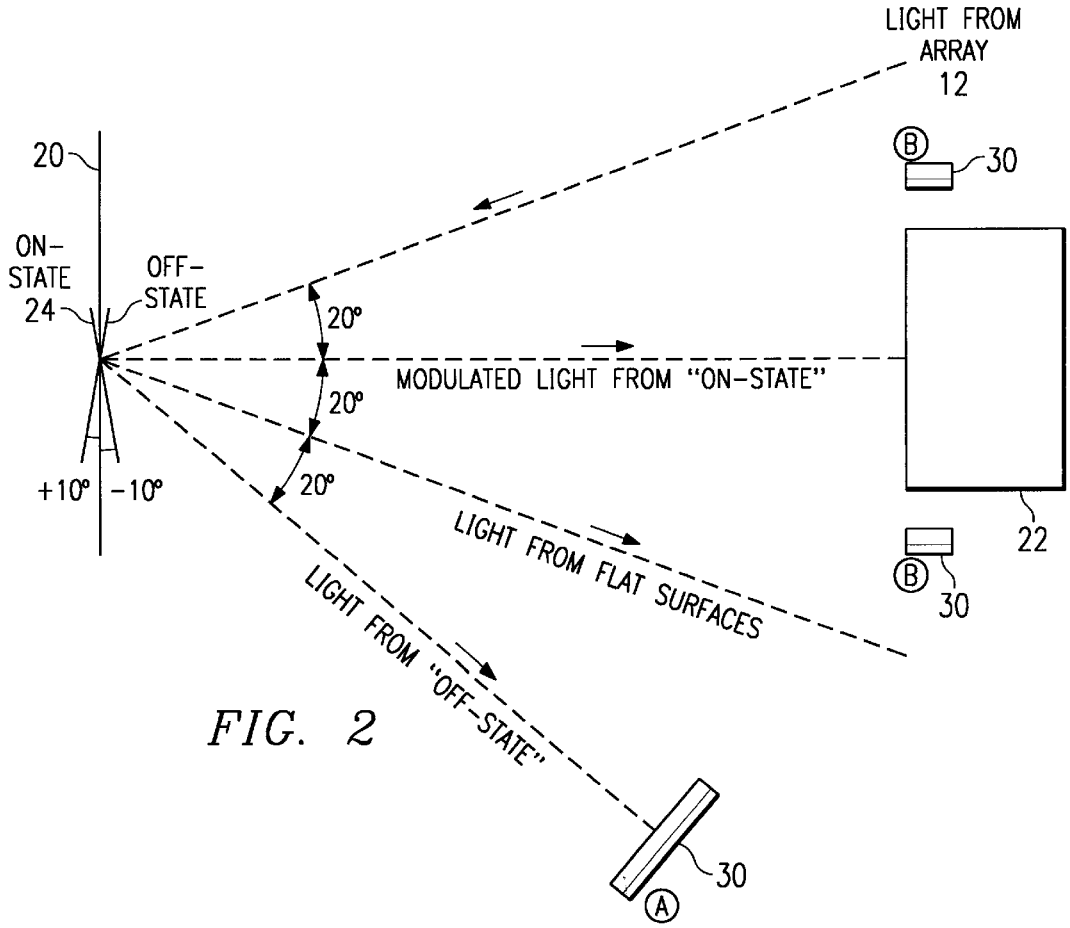
FIG. 2 is an optical schematic illustrating the paths of light from a DMD spatial light modulator whereby incident light is directed by pixel mirrors in the on-state to a projector lens, and by pixel mirrors in the off-state away from the projector lens.

As shown in FIGS. 1 and 2, there are three locations suitable for placing the light sensor 30 according to the preferred embodiment of the present invention. In a first location labeled A, sensor 30 is placed at the off-state focal point to receive reflected light from each of the individual mirrors of DMD 20 positioned in the off-state. That is, when each of the mirrors 24 are in the off-state, they direct the incident light toward the sensor 30. In essence, sensor 30 sum totals the light from each of the off-state mirrors 24. As will be described shortly, during calibration, zones or blocks of pixel mirrors are turned off, one zone at a time, with the other mirrors being placed in the on position and sensor 30 senses the intensity of received light. See FIG. 3.

Referring to FIG. 2, this first embodiment of the present invention is schematically shown whereby each pixel mirror 24 of the DMD array 20 is tilted to the off-state to reflect incident light, toward sensor 30 positioned at A.

Figure 3:
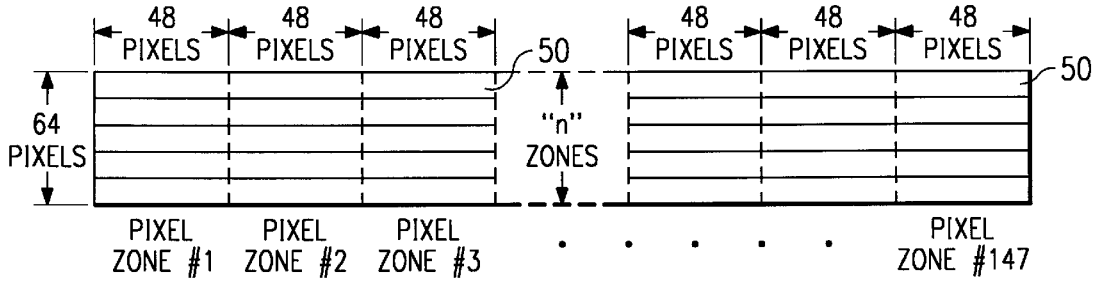
FIG. 3 is an illustration of how the spatial light modulator is enabled in zones or blocks, sequentially across the entire device to characterize the light emitted from the array of light emitting elements to obtain a signature thereof.

Referring back to FIG. 1, according to second alternative embodiment of the present invention, one light sensor 30 is placed adjacent the projection lens 22 to sense the intensity of light overfilling the projection lens 22. Preferably, a separate sensor 30 is provided on each side of the projection lens 22, as shown. In this location, the photosensor 30 senses the light overfilling the projection lens 22 when each of the mirrors 24 is in the on-state. Again, during calibration of the array 12 the DMD 20 is controlled so that one zone of pixel mirrors 24 at a time is turned to the on-state, sequentially across the entire array, as shown in FIG. 3. Each of the sensors 30 senses the intensity of the light reflected thereto for each of the enabled zones of pixel mirrors 24. Although the light output from each light emitting element 14 is mixed in the lateral direction by the holographic diffusers, generally, only a few light emitting elements 14 illuminate each corresponding zone of the mirrors. Thus, those zones of pixels which are characterized as reflecting a lower combined light output as detected by sensor 30 can be utilized to determine which corresponding light emitting elements 14 are deficient in light output. The drive current provided to each of these light emitting elements 14 is adjusted accordingly until the light sensor 30 detects a proper intensity of light, within tolerance, as each of the zone of pixel mirrors 24 are sequentially turned on.

Because of the high diffusivity of the illumination at the imaging lens 22, there exists sufficient overfill to utilize detector 30 in position B for the "on-state" capture of energy. The diffused beam presented to the lens 22 is of an elliptical shape, with the longer dimension being about 3× longer than the vertical dimension. Thus, there is sufficient light energy immediately adjacent to the imaging lens 22 across the horizontal dimension to activate the small detector 30. Adequate signal-to-noise ratios are achieved for each of the DMD zones chosen as calibration references.

Referring again to FIG. 2, the reflection of incident light directed from the mirrors in the on-state can be detected adjacent the projection lens 22 is shown at B.

Referring back to FIG. 1, there is shown a third alternative embodiment of the present invention for sensing the on-state illumination by sensing the nucleus of the light beam as it exits the imaging lens 22. As shown, a beam splitter/collection lens 40 is selectively placed in the optical path of the light at the output of the imaging lens 22. Optionally, a mirror is used in place of the beam splitter 40 and can be switched in and out of the optical path to reflect on-state light to a collection lens 46. The collection lens 46 forms a miniature image of the DMD source, and focuses it upon the suitable apertured optical detector 30 in position C. Measurement and calibration using characteristic light intensity signatures from each pixel zone is the same as in the previous two preferred embodiments. However, measurement of signatures and total light energy from the DMD with this approach includes the effects and/or losses due to the imaging lens 22.

To better understand the calibration of light elements 14 according to the present invention, reference is now made to FIG. 3. Regardless of the position of sensor 30, the pixel zones 50 forming the spatial light modulator 20 are sequentially actuated, one zone at a time. For purposes of illustration of the present invention but without limitation to this embodiment, a spatial light modulator 20 being 64 pixels high by 7,048 pixels wide is functionally partitioned into zones 50, each zone being 64 pixels high and 48 pixels wide to detect the intensity of light across the spatial light modulator and determine the uniformity in the cross-process direction at the image plane. Each zone 50 is turned on or off, depending on the location of the sensor 30, one at a time, from left to right, with the light output signature being detected by the light sensor 30. The light output signature from each actuated zone 50 is determined, whether the pixel mirrors 24 are put into the on-state or the off-state, and then compared to an ideal standard stored in a look-up table. The look-up table can be originated/derived by computer models or empirical measurements from a golden standard light source implemented in an actual optical system which produces uniform illumination at the image plane. The drive currents to the corresponding individual light emitting elements 14 known to illuminate that pixel zone are then adjusted if necessary to obtain uniform illumination at the image plane, and the sequence is repeated.

For example, if the 35th and 36th pixel zone 50 are determined to be illuminated 5% below that considered to be standard to have uniform illumination at the image plane, the specific 4 or 5 light emitting elements 14 known to illuminate those zones, due to mixing and beam overlap, are each adjusted according to an adjustment look-up table to have their drive currents increased such that these pixel zones 50 of the spatial light modulator 20 are properly illuminated to produce uniform illumination at the image plane as dictated by the look-up table. The light emitting elements 14 of a 24 illuminator array primarily associated for illuminating the 35th and 36th zones are adjusted to attain uniform illumination at the image plane. For instance, the light emitting element #6 is increased 3%, element #5 and #7 each being increased 2%, and illuminator #4 and #8 each being increased 1%. This adjustment process can be repeatedly performed until the intensity detected by sensor 30 from the spatial light modulator is proper, within tolerance, for each of the zones of pixels.

Figure 4:
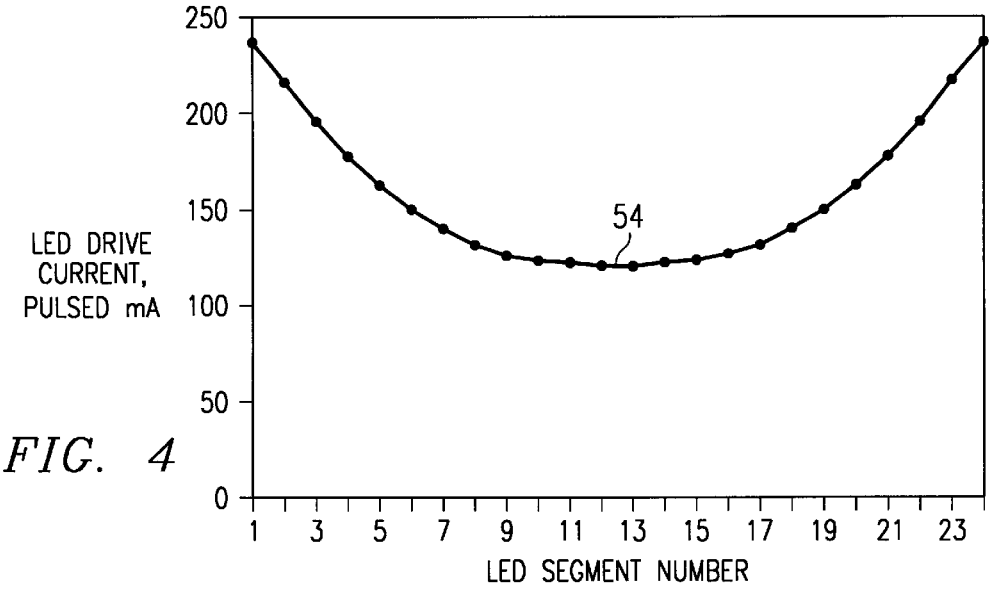
FIG. 4 is a graph of the drive currents for an array of ideal LED's which generate a uniform intensity of light at an image plane.

Referring now to FIG. 4, there is shown plotted at 54 the "ideal" drive currents of an LED array 12 having 24 "ideal" LEDs, or 24 LED sections. As shown, the drive currents for the LEDs or LED sections at each end of the array are larger than the drive currents for the LEDs or LED segments at the center of the array to compensate for the normal cosine falloff of optics and other aberrations of the optical system. The plotted drive currents shown in FIG. 4 will produce a uniform intensity of light at the image plane if all the LEDs 14 are perfect optically and electrically, and with each DMD reflecting the same amount of light. However, perfect LEDs 14 are generally not available in production, and thus each of the LEDs will generate a different light output for a given drive current. The differences of one production LED from the next need to be taken into account to ensure uniform illumination at the image plane, taking into account the aberrations of the optical system as well.

Figure 5:
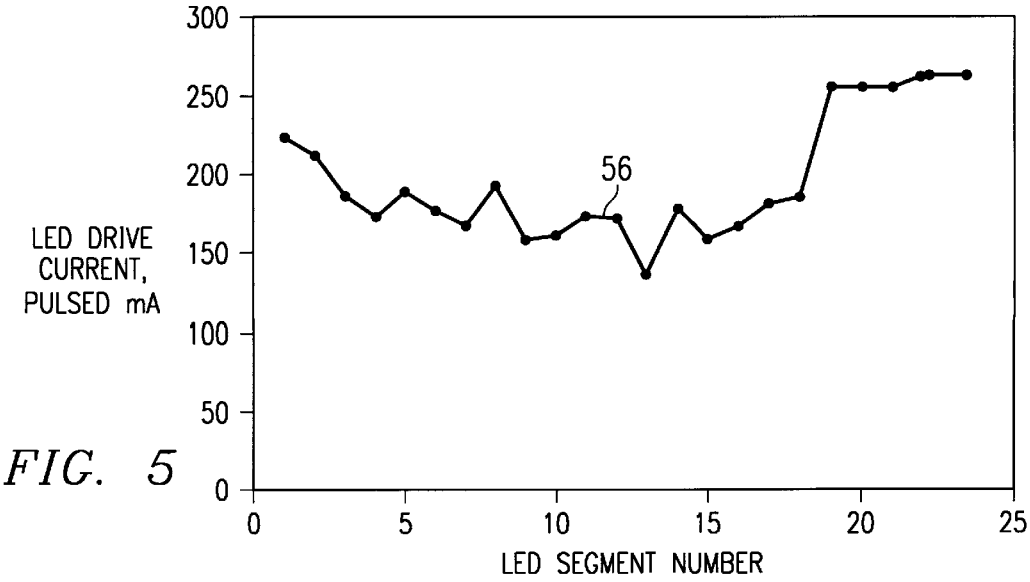
FIG. 5 is a graph illustrating the drive currents of an array of typical production LED's to generate a uniform intensity of light at an image plane.

Referring now to FIG. 5, there is shown plotted at 56 the typical drive currents for the various LEDs 14, or LED sections, taking into account the varying LED efficiencies of production LEDs to provide uniform illumination at the image plane. As compared to FIG. 4, it can be seen that the LEDs 14 are still driven harder at each end of the LED array 12 to take into account the normal cosine falloff of the optics and other aberrations thereof. However, it can be seen that the drive currents of adjacent LEDs 14 can vary dramatically from one to the next for production type LEDs to ensure uniform illumination at the image plane. One LED may be more efficient than the next, which principally accounts for the differences in drive currents as shown in FIG. 5.

In production, the drive currents for each of the LEDs 14 of array 12 need to be custom set when using production LEDs to ensure uniform illumination at the image plane. Production LEDs of the same type are known to vary between 30% and 50% in light output. In addition, positioning of the emitter in the package can cause variations, i.e., the emitter may not be orthogonal to the lens of the package. Moreover, the actual mechanical placement of the device can create errors. Each illumination system 10 will actually have a different plot of drive currents, as shown in FIG. 5, to account for the variation in particular LED efficiencies for each system. The present invention provides for custom setting the drive currents of the LEDs, automatically, to ensure uniform illumination intensity at the image plane. The drive currents are initially set as shown in FIG. 4, and then adjusted according to the present invention until the illumination signature detected across the spatial light modulator is within tolerance, as compared to the golden standard, to ensure uniform illumination across the image plane. This adjustment may be an iterative technique, adjusting the drive currents for LEDs associated with a few zones 50 at a time, until the illumination of the spatial light modulator 20 is within tolerance.

The process described so far insures light uniformity at the image plane in the cross-process direction. To further insure light uniformity at the image plane in the process direction, each of the zones 50 can be further partitioned in the vertical direction into "n" zones, as shown in FIG. 3. Using this approach, for instance if 8 zones are selected (n=8), 8 pixels comprise each zone in the vertical direction. Each 8×64 zone of pixels is turned on, one at a time, to determine the intensity of the light in the vertical (process) direction. Such an approach is useful if an area array of LEDs 14 is utilized, and the corresponding light emitting elements 14 can have the drive currents increased or decreased to insure each zone or sub-zone is properly illuminated by the LED array 12.

Figure 6:
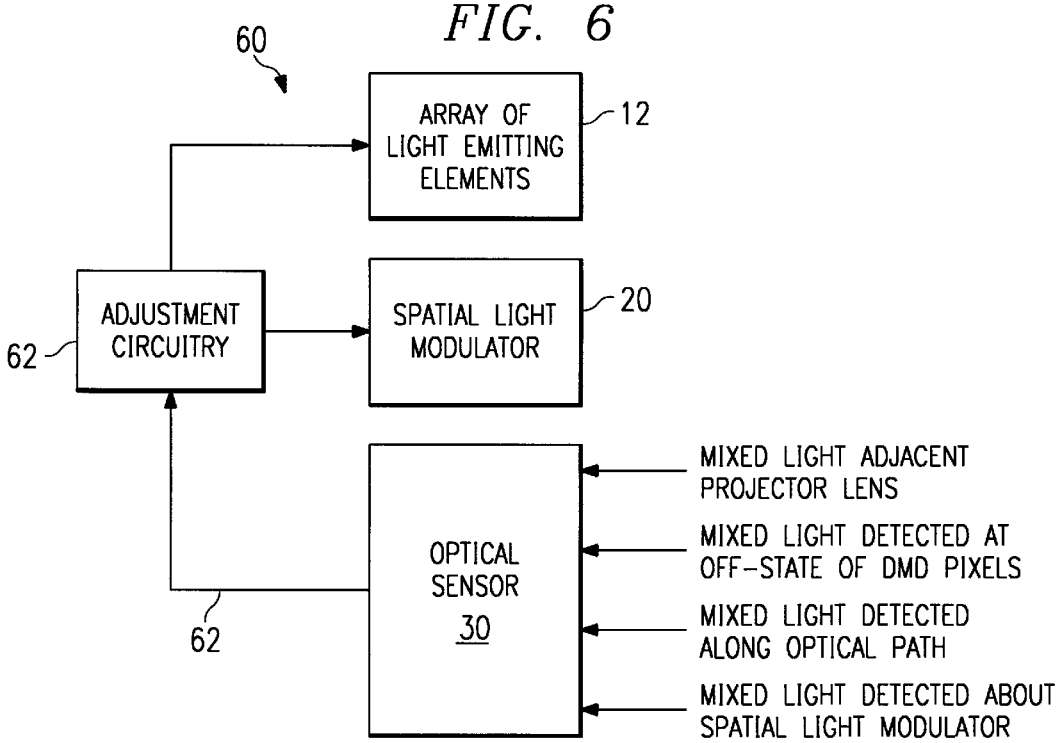
FIG. 6 is a functional block diagram illustrating an adjustment circuitry controlling the spatial light modulator one zone at a time and obtaining the associated optical sensor output as the spatial light modulator is enabled in zones as shown in FIG. 3, the optical sensor receiving light in one of the four ways.

Referring to FIG. 6, there is shown a functional block diagram for the calibration system 60 according to the present invention. Adjustment circuitry 62, such at that typically used to control the pixels of spatial light modulator 20, is utilized to actuate the spatial light modulator in zones, one zone at a time as previously described. That is, when a calibration process is determined to be made, the adjustment circuitry 62 actuates one zone at a time of the spatial light modulator 20. The optical sensor 30 senses the received intensity of the light (signature) reflected thereto, or transmitted thereto in the case of a transmissive type spatial light modulator such as a LCD. The sensed intensity of light (signature) is provided by sensor 30 to the adjustment circuitry. The adjustment circuitry has a look-up table with standardized values, known as the golden standard, and compares the sensed signature against the golden standard as each zone of a spatial light modulator is actuated. Adjustment circuitry 62 is provided with an adjustment look-up table for automatically calibrating and controlling the drive currents to the array of light emitting elements shown at 14. The adjustment circuitry 62 adjusts the associated drive current, if necessary, to each of the light emitting elements 14 that are determined by circuitry 62 to be deficient in light intensity output such that the signature is within tolerance of the golden standard to attain a uniform intensity of light at the image plane. In place of a table, an equation can be stored in the adjustment circuitry. Circuitry 62 calculates the drive signal levels for each light emitting element 14 as a function of the optical energy provided by sensor 30 as each zone is actuated, again, whether each pixel zone is actuated in the off-state or on-state for the various embodiments shown.

Figure 7:
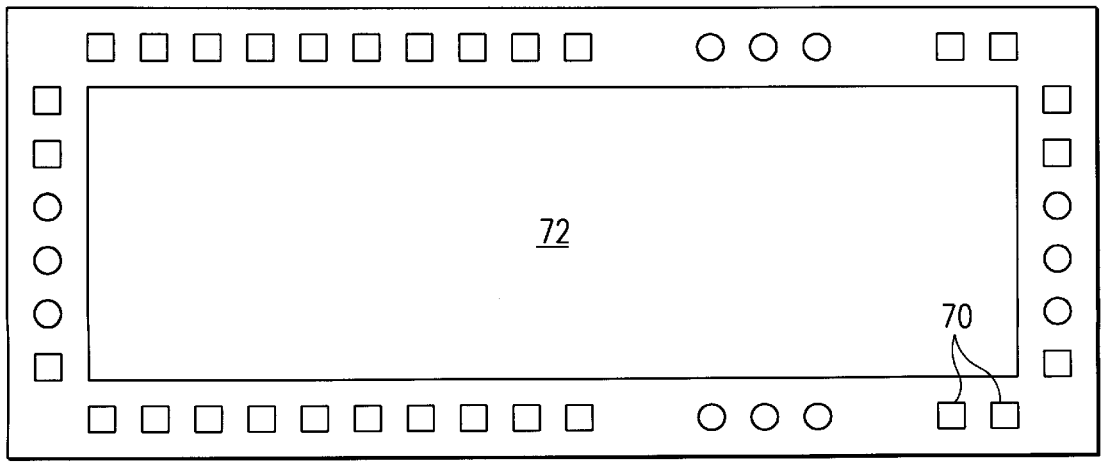
FIG. 7 is a view of an alternative embodiment whereby a series of optical sensors are formed integral with and encompassing the spatial light modulator to sense the light over filling the spatial light modulator to determine the uniformity of light illuminating the spatial light modulators in the previous embodiments.

Referring now to FIG. 7, there is shown yet another fourth alternative embodiment to the present invention. Here, a spatial light modulator is provided with integral photodiodes 70. A series of photodiodes 70 are integrally defined about the active portion 72 of a spatial light modulator. The DMD spatial light modulator is an integrated semiconductor formed using conventional semiconductor processing. The simple photodiodes 70 are closely defined around the active area 72 of the spatial light modulator such that the detectors 70 in the cross-process (horizontal) direction receive light at the same intensity distribution as the DMD active pixel area in the cross-process direction. The detectors 70 in the process (vertical) direction receive the same intensity distribution as the DMD active area in the process direction. The variation of light intensity in the cross-process or horizontal dimension can be determined by reading the outputs of the detectors in the horizontal dimension at the top and bottom of the spatial light modulator. The variation of the illumination in the process (vertical dimension) can be determined by reading the detector outputs in the vertical direction at the ends of the DMD. Since the illumination varies slowly in the process dimension for most illuminators, the process direction variation can also be obtained by comparing the outputs of the pair of detectors which are aligned vertically in the two horizonal rows of detectors. Using the look-up table stored in adjustment circuitry 62, the signatures from the detectors can be compared to the golden standard, and the drive currents to each of the light sources 14 can be appropriately adjusted, where necessary, to provide proper illumination of the spatial light modulator and uniformity at the image plane.

Though the invention has been described with respect to a specific preferred embodiment, many variations and modifications will become apparent to those skilled in the art upon reading the present application. It is therefore the intention that the appended claims be interpreted as broadly as possible in view of the prior art to include all such variations and modifications.

What is claimed is:

1. An illumination system, comprising a) an array of individual light emitting elements for emitting light, said light emitted by each of said light emitting elements having an intensity;

b) a light mixing device mixing said light emitted by said light emitting elements to provide a mixed light output;

c) a spatial light modulator having an array of pixels illuminated by said mixed light output, said array of pixels arranged as a plurality of pixel zones, each pixel zone containing a subarray of said array of pixels, each of said light emitting elements having a greater potential illuminating effect on certain ones of said subarrays of pixels relative to other ones of said subarrays of pixels;

d) a light sensor providing a light sensor output indicative of the amount of light sensed by said light sensor, said light sensor being illuminated by said mixed light output transmitted from said array of pixels; and e) adjustment circuitry selectively controlling individual ones of said subarrays of said array of pixels for light transmission to said light sensor and, in response to said light sensor output, said adjustment circuitry individually adjusting the intensity of the individual light emitting elements of said light emitting device more closely associated with illumination of the selected subarray as a function of said light sensor output in accordance with a predetermined standard.

2. The illumination system as specified in claim 1 wherein said adjustment circuitry selectively controls the entire pixel array to characterize the intensity of the emitted light of each said light emitting element.

3. The illumination system as specified in claim 1 further comprising a projector lens focusing light from said spatial light modulator, along an optical path to an image plane, wherein said sensor is positioned adjacent said projector lens.

4. The illumination system as specified in claim 3 further comprising a reflector selectively positionable in said optical path to direct said light from said projector lens to said sensor.

5. The illumination system as specified in claim 4 further comprising a lens positioned between said reflector and said sensor.

6. The illumination system as specified in claim 1 wherein said spatial light modulator comprises a digital micromirror device (DMD) having an array of reflectable elements, each deflectable between an on-state and an off-state, said sensor being positioned to sense reflected light from said reflectable elements in the off-state.

7. The illumination system a s specified in claim 1 wherein said array of light emitting elements is elongated.

8. The illumination system as specified in claim 7 wherein said elongated array of light emitting elements are arcuately arranged.

9. The illumination system as specified in claim 1 wherein said light mixing device comprises a holographic diffuser.

10. The illumination system as specified in claim 1 further comprising a cylindrical lens compressing said emitted light from said light emitting elements.

11. The illumination system as specified in claim 1 wherein said light sensor is adjacent said spatial light modulator.

12. The illumination system as specified in claim 11 wherein said light sensor is integral to said spatial light modulator.

13. An illumination system, comprising:

a) an array of individual light emitting elements emitting light, said light emitted by each of said light emitting elements having an intensity;

b) a light mixing device mixing said light in a lateral direction;

c) a spatial light modulator having an array of pixel elements illuminated by said mixed light;

d) a plurality of light sensors positioned about a periphery of said spatial light modulator adjacent said spatial light modulator and integral to said spatial light modulator providing a light sensor output, said light sensors also illuminated by said mixed light; and e) adjustment circuitry individually adjusting said intensity of said individual light emitting elements as a function of said light sensor output.

14. A method of calibrating individual light emitting elements of an array of light emitting elements which comprises the steps of:

providing an array of light emitting elements, each of said light emitting elements emitting light of a measurable intensity;

mixing the light emitted from said light emitting elements to provide a mixed light output;

providing a spatial light modulator having an array of pixels illuminated by said mixed light, said pixels arranged as a plurality of pixel zones, each pixel zone containing a subarray of said array of pixels, each of said light emitting elements having a greater potential illuminating effect on certain ones of said subarray of pixels relative to other ones of said subarrays of pixels;

modulating the mixed light output received from said light emitting elements with said spatial light modulator;

providing a light sensor for sensing said modulated mixed light and providing a light sensor output indicative of the amount of light sensed by said light sensor;

providing an indicator for an acceptable range for the amount of light sensed by said light sensor; and selectively controlling individual ones of said subarrays of said array of pixels for light transmission to said light sensor and, in response to said light sensor output and individually adjusting the intensity of said individual light emitting elements of said light emitting device more closely associated with illumination of the selected subarray as a function of said light sensor output in accordance with said indicator.

15. The method of claim 14 wherein said steps of modulating include the steps of modulating said mixed light to one of off-state, on-state or a portion of the light projected in the on-state.

* * * * *